United States Patent [19]

Santa Lucia

[11] 4,433,492

[45] Feb. 28, 1984

[54] HAIR DRYER INSERT TO MAINTAIN HAIR POSITION

[76] Inventor: Ralph Santa Lucia, 948 Rose Ave., Venice, Calif. 90291

[21] Appl. No.: 250,571

[22] Filed: Apr. 3, 1981

Related U.S. Application Data

[63] Continuation-in-part of Ser. No. 139,834, Apr. 14, 1980, abandoned.

[51] Int. Cl.[3] ..... A45D 20/24

[52] U.S. Cl. ..... 34/99; 34/243 R; 132/9; 239/34; 239/145

[58] Field of Search ..... 2/198, 175, 195, 194; 239/34, 145; 98/40 R; 34/97, 96, 99, 100, 243 R; 132/7, 9

[56] References Cited

U.S. PATENT DOCUMENTS

| | | | |
|---|---|---|---|
| 1,660,770 | 2/1928 | Solomon | 2/175 |
| 1,904,108 | 4/1933 | Walsh | 2/198 |
| 3,992,785 | 11/1976 | McCachren | 34/99 |
| 4,230,279 | 10/1980 | Forsberg | 34/96 |
| 4,301,601 | 11/1981 | Carr | 34/99 |

*Primary Examiner*—Larry I. Schwartz

*Attorney, Agent, or Firm*—Cislo, O'Reilly & Thomas

[57] ABSTRACT

A fluid diffusion member, particularly useful for insertion in the hood of a hair dryer, or the like, wherein the diffusion member is shaped congruently and adapted to be retained within the hood of the hair dryer so as to diffuse the heated air emanating from the source of heated fluid so as not to disrupt the hairdo, or the like, of the individual using the hair dryer. The fluid diffusion member is, in one embodiment, dome-shaped and molded of an open pore polyurethane foam which satisfactorily breaks up the air, permitting adequate drying without attendant disruption of the hairdo. In other embodiments, interconnected segments make up the diffusion member.

16 Claims, 8 Drawing Figures

HAIR DRYER INSERT TO MAINTAIN HAIR POSITION

REFERENCE TO RELATED APPLICATIONS

This application is a continuation-in-part application of pending application Ser. No. 06/139,834 filed Apr. 14, 1980 now abandoned.

BACKGROUND OF THE INVENTION

With many of the modern hair styles today, it is necessary, because of the so-called "natural" look, to employ heat lamps, or the like, in order to dry the hair so that the "natural" look is obtained. That is, the "natural" hairdos require drying of the hair in the natural state so as to obtain the resultant "natural" look.

The use of conventional hair dryers, whether they be hand-held, or of the ubiquitous, hooded type, will not suffice for modern-day hairdos, in that the large volumes of air directed to the hairdo cause disruption of same. It has thus been necessary in creating "natural" look hairdos, to employ high-energy using heat lamps which only permit spot drying, thereby necessitating movement of the heat source at specific time intervals in order to have overall drying.

The diffusion member of the instant invention permits the utilization of conventional hair dryers, and makes them readily adaptable for drying of "natural" style hairdos, and also permits ready conversion of the hair dryer to the conventional mode, should the need arise. The instant invention also alleviates the necessity of using heat lamps which are wasteful from an energy standpoing, and which require close attention, so as not to create "hot spots" with regard to the individual having his/her hair dried. Additionally, the device permits drying of the hair without disruption of the intended overall "natural" look that is sought to be obtained.

OBJECTS AND SUMMARY OF THE INVENTION

It is an object of the invention to provide a fluid diffusion member to use with heated fluids wherein the diffusion member is placed intermediate the object to be dried and the source of heated fluid.

It is another even more important object of the invention to provide a fluid diffusion member for use in hair drying, or the like, wherein the diffusion member is of lightweight, open-pore, foamlike material, having a dome-like or non-planar configuration.

It is another even further specific important object of the invention to provide a fluid diffusion member for use with hair dryer hoods, and the like, wherein the diffusion member is congruently shaped to be frictionally retained within the hood of the dryer.

It is another even more specific and important object of the invention to provide an open-pore, polyurethane, foam member, congruently shaped to be received within the hood of a conventional hair dryer, wherein air passing from the hood is diffused in a manner so as not to disrupt the hairdo of the person using the hair dryer.

It is another even further, even more specific and important object of the invention to provide a dome-shaped member of open-pore, lightweight material, which is congruently shaped to and adapted to cooperate with a source of heated air, so as not to cause disruption of the "natural" look of the hairdo being dried.

It is another even further, more specific important object of the invention to provide a member of open-pore, lightweight material, wherein the member is readily adapted to be frictionally retained within the hood of a hair dryer, or the like, for diffusing the air emanating therefrom and individual pie-shaped segments, having a unique configuration, form the member.

In an exemplary embodiment, the invention is directed to a fluid diffusion member for use with heated fluids comprising a member of open-pore, lightweight material, being shaped and adapted to cooperate with a source of heated fluid and having a thickness sufficient to satisfactorily diffuse the heated fluid emanating from the source of heated fluid.

These, and further objects, will become apparent from the hereinafter following commentary, taken in conjunction with the figures of drawing.

DESCRIPTION OF THE BEST EMBODIMENTS CONTEMPLATED

Figure 1:
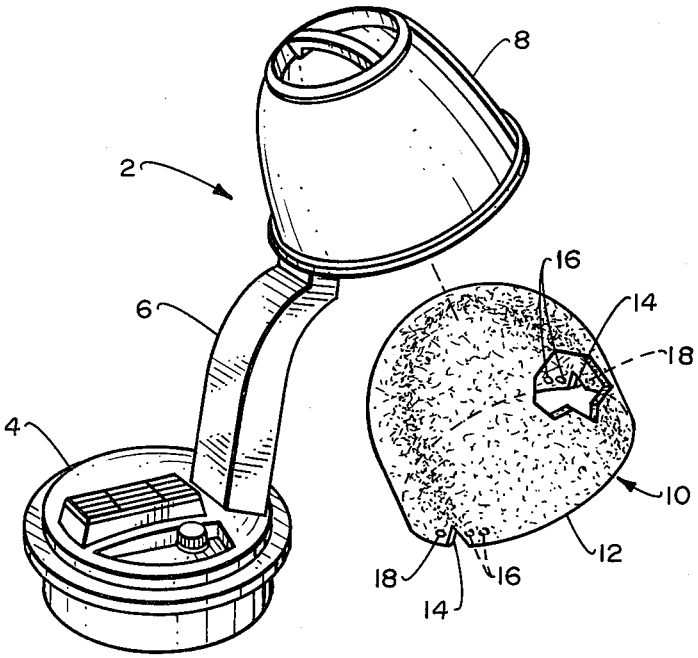
FIG. 1 is a perspective view of a conventional hair dryer, employing a hood, and illustrating the fluid diffusion member of the invention in the position about to be adapted for retention within the hood.

Referring to the figures of drawing, it will be noted that the convention hair dryer 2, for example, of the type that may be found in hair dressing salons, or in the home, employs a base member 4, housing a fan and heating unit, not shown, and connected via air conduit stand member 6, to the hood 8. It should be understood that the hood 8 may be of any relative shape, as would be found in hair dryers of the type under consideration.

The fluid diffusion member 10 of the invention is generally non-planar or arcuately shaped, or otherwise configured, so as to be congruent to the interior surface of hood member 8. The fluid diffusion member 10 is of open-pore, molded polyurethane foam having a wall thickness of about one-quarter to one-half inch, although other thicknesses, of course, will suffice, depending upon the end result desired.

The diffusion member 10 may be adequately molded from polyurethane foams of rather open-pore design, having from about 10 to 60 pores per linear inch. A satisfactory foam having 30 pores per linear inch has been found to accomplish the end results of the invention. A foam material meeting the foregoing specifications, and put out by the Foam Division of the Scott Paper Company of Chest, Pennsylvania, is ideal for the practice of the invention. Generally, the reticulated polyurethane foams are about 97% void volume, offered in a variety of textures. There are no membranes connecting the thousands of internal skeletal strands, thereby providing the material with excellent permeability and high area. The material is washable, and thus, lends itself quite readily to commercial, beauty parlor use.

Figure 4:
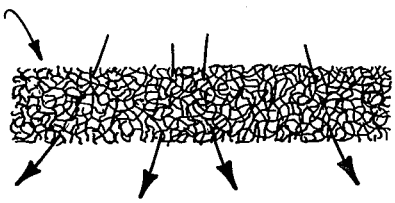
FIG. 4 is an enlarged fragmented view of a wall of the fluid diffusion member of the invention, illustrating the open-pore construction thereof.

Ideally, the foam material utilized for the heat diffusion member is fire-resistant, and may be sufficiently strong, so that in the molded state, it is self-standing, and needs no internal supports, although, as will be seen in another embodiment of the invention, foam material not free-standing in strength, would also be useful in the practice of the invention. The materials utilized should be of sufficient thickness and of sufficient pore volume, so as to be capable of diffusing the air coming, for example, from the interior of hood 8, passing through the wall of the fluid diffusion member, as depicted in FIG. 4, in a retarded mode, so as not to disrupt the hairdo on the head of the person with which the hair dryer 2 is utilized.

The fluid diffusion member 10 has a lower perimetric edge 12 with spaced slits 14 with fastening means 16 and 18 on either side of the slits 14, in this particular instance, taking the form of velcro cooperative snaps, so as to be able to decrease the circumferential edge length of perimetric edge 12, for purposes that will become apparent.

Figure 2:
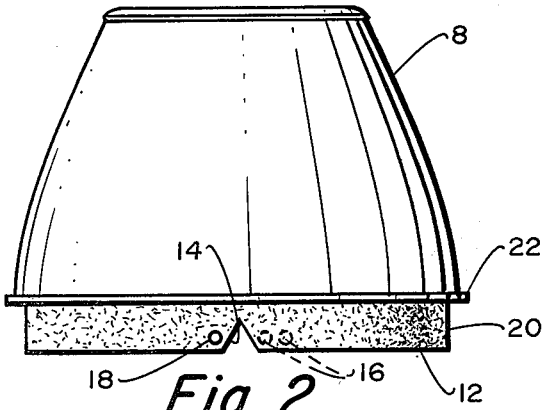
FIG. 2 is a side view of a conventional hair dryer hood, illustrating the diffusion member of the invention therein, and about to be positioned therewith.
Figure 3:
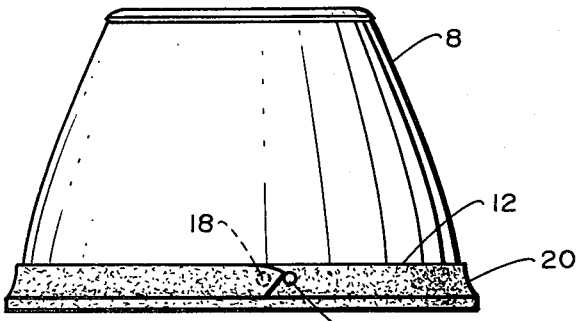
FIG. 3 illustrates the fluid diffusion member of the invention, in the retained position within the hood of a hair dryer.

After the fluid diffusion member 10 is inserted in the hood as shown in FIG. 2, the lowermost depending portion 20 is upturned over the lower edge 22 of hood 8, as shown in FIG. 3, and the velcro fastening means 18 and 16 fastened so as to securely retain the fluid diffusion member 10, in association with the hood 8. The hood 8 is now readied to be associated with the head of a person having a "natural" hairdo which requires drying. Activation of the hair dryer 2 causes low, barely perceptible air flow because of the fluid diffusion member 10, but readily permits radiant heat to penetrate and contact the hairdo, to thereby perform the drying function.

Figure 5:
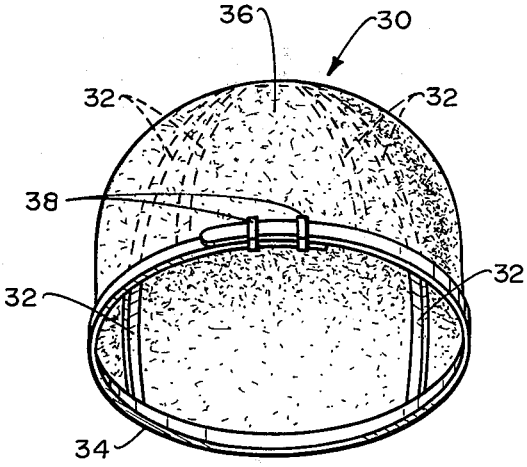
FIG. 5 is an alternative embodiment of the fluid diffusion member of the invention.

Referring now to FIG. 5, there is shown one alternative embodiment of the invention, wherein the fluid diffusion member 30 is comprised of a lesser-strength material, and, wherein rib-like internal bands 32 supported from expansible lower band 34 form the means of rigidly securing the polyurethane or other foam material 36, which is spherically molded or dome-shaped in the form shown in FIG. 5.

In this embodiment of the invention, the fluid diffusion member 30 is merely inserted, for example, in the hood 8 of a conventional dryer 2, and the band 34 expanded so as to frictionally contact the inner, lower surface of hood 8, to thereby retain the fluid diffusion member 30 in place.

The lower band 34 is provided with strap or confining members 38, so as to permit expansion or reduction in the circumference of band 34. The band 34 and supporting ribs 32 may be made of a heat-resistant, lightweight plastic material, or similar such materials as those or ordinary skill in the art will recognize.

Figure 6:
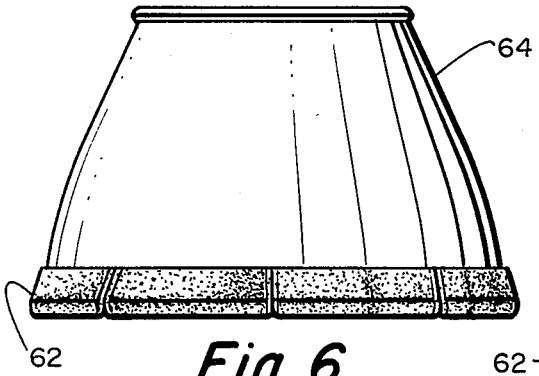
FIG. 6 is a view similar to FIG. 3, illustrating still another embodiment of the invention.
Figure 7:
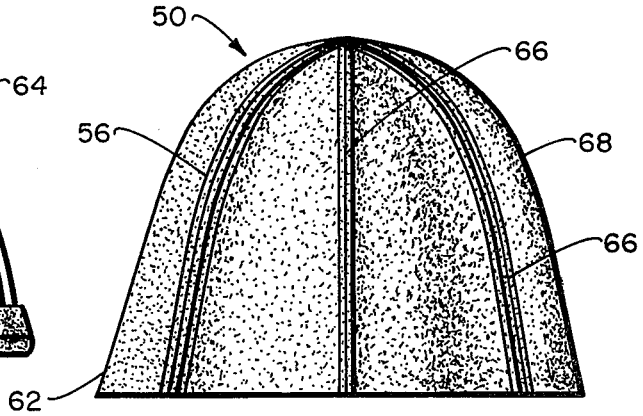
FIG. 7 is a side, elevational view of the still another embodiment of the invention.
Figure 8:
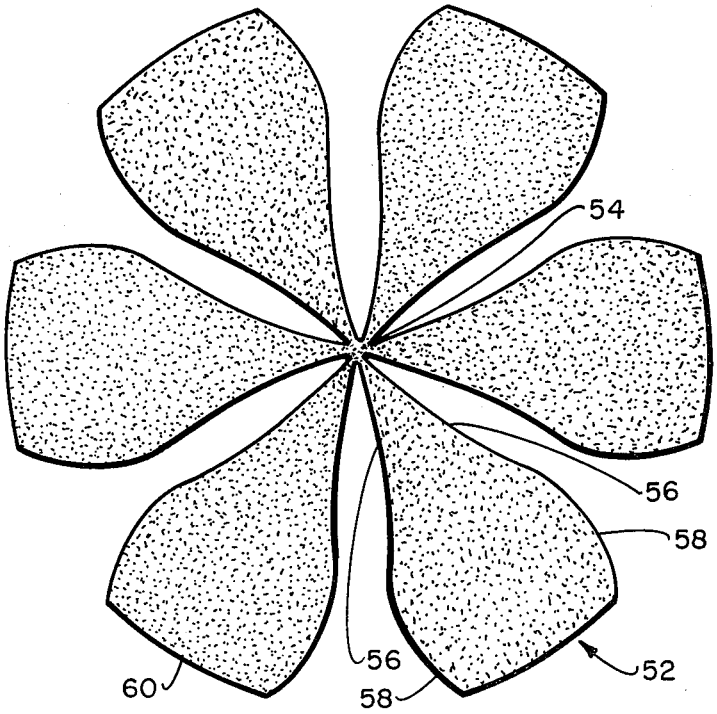
FIG. 8 is a plan view of the still another embodiment of the invention illustrating the configuration of the segments making up the depicted embodiment.

Referring now to FIGS. 6, 7 and 8, the still another embodiment of the fluid diffusion member 50 is illustrated. In this particular embodiment, the member 50 is made up of individual pie-shaped-like segments 52 connected at the apices 54 and along the lateral edges 56 by means of sewing, cementing or otherwise securing, so as to form the dome-shaped configuration of the diffusion member 50 as shown in FIG. 7. Obviously, in this embodiment, layer foam material, as opposed to the pre-shaped or molded form, makes up the individual segments.

Each of the segments 52, it will be noted, have a configuration wherein the lateral sides 56 are somewhat curvilinear in configuration deviating from a true pie or arcuate-shaped section, and having inwardly directed sides 56 coming to a terminus 54 and having an inwardly curved portion 58 on each of the lateral sides 56, terminating in the edge 60.

When the individual segments 52 are secured together in the manner previously described and as shown in FIG. 7, a dome-shaped member 50 is formulated which has a certain tensioning characteristic along the bottom portion 62 which, upon insertion into the hair dryer hood 64 or the like, may be turned up as shown in FIG. 6 so as to adequately and securely be frictionally retained in gripping or tensioned position about the bottom edge of the dryer hood 64, in a releasable, removable manner.

In all respects the embodiment shown in FIGS. 6–8, inclusive, performs the same function and is of the same materials of construction as the previously described embodiments, with the exception of the individual segments 52 of the unique configuration shown, making up the member 50 and having the seams 66 formed on the outer surface 68 of the member 50 as illustrated in FIG. 7. The seams 66, of course, will be of relatively small size depending upon the medium used to secure each of the segments and where bonding or fusion is contemplated, depending upon the porous material utilized to make up the member 50, the seam overlap may be almost eliminated and, of course, individual sewing of these segments together to form the member 50 may also be resorted to, in which case a thread, fiber of the like, of compatible quality with the porous material, should be utilized which will have the same washable and heat-resistant characteristics as the material making up the member 50.

There has now been disclosed a fluid diffusion member, particularly useful for drying of hair, wherein high energy usage lamps are no longer required, and hair drying facilities as conventionally found in beauty salons and elsewhere, readily adapted to perform hair drying functions for hairdos which cannot tolerate high volume air flows or disruption without disrupting the hair style itself.

While specific details of construction have been disclosed for the invention, those of ordinary skill in the art will at once recognize alternative means, for example, of securing the fluid diffusion member, the various fastening means for associating same with the hood or the like of a dryer, and, while specific types of polyurethane foam have been disclosed, those of ordinary skill in the art will, at once, recognize that alternatives are available, and, all such alternatives are intended to be covered by the appended claims.

I claim:

1. A fluid diffusion member for use with heated fluids, comprising: a non-planar conformable member of open-pore, lightweight material, being shaped and adapted for cooperative association with a source of heated fluid, and having a thickness sufficient to satisfactorily diffuse the heated fluid emanating from said source, said diffusion member being spaced from the object to be heated and wherein said heat source is a hooded hair dryer and said fluid diffusion member is congruently shaped to the configuration of the interior of the hood of said hooded hair dryer.

2. The fluid diffusion member, in accordance with claim 1, wherein said member is dome-shaped, and includes spaced rib-like supporting members therefor.

3. The fluid diffusion member, in accordance with claim 2, including a lower expansible, annular-shaped member, which is adjustable for friction retention cooperation with the interior surface of a hood of a dryer.

4. The fluid diffusion member, in accordance with claim 1 wherein said fluid diffusion member consists of a plurality of joined segements, each segement being secured to the lateral edges of an adjoining segement.

5. The fluid diffusion member in accordance with claim 4 wherein each of said segments are pie-like section in shape and are secured by sewn thread.

6. The fluid diffusion member in accordance with claim 4 wherein each of said segments are triangular in shape, and each have a curvilinear lateral edge portion defining a base of reduced width relative to the immediate adjoining portion thereof.

7. The fluid diffusion member in accordance with claim 6 wherein the lateral edges of each segment curve inwardly adjacent the base portion thereof.

8. The fluid diffusion member, in accordance with claim 1, wherein said congruently shaped member is heat-resistant, and, is made of a molded material of sufficient strength to make said diffusion member free-standing.

9. The fluid diffusion member, in accordance with claim 8, wherein said member is dome-like in configuration.

10. The fluid diffusion member, in accordance with claim 9, wherein said member is of molded, polyurethane foam, of about one-quarter to one-half inch wall thickness.

11. The fluid diffusion member, in accordance with claim 9, wherein said diffusion member is of a size and shape adapted to be frictionally retained within the hood of a hair dryer.

12. The fluid diffusion member, in accordance with claim 11, wherein the lower perimetric edge thereof is selectively reducible in size.

13. The fluid diffusion member, in accordance with claim 12, including spaced fastening means to facilitate securement of said diffusion member within the hood of a hair dryer, or the like.

14. A fluid diffusion member for use with heated fluids comprising: a member of open-pore, lightweight, molded and heat-resistant material of polyurethane foam of about $\frac{1}{4}$ to $\frac{1}{2}$ inch wall thickness; being shaped and adapted to be frictionally retained within the hood of a hair dryer, and having a thickness sufficient to satisfactorily diffuse the heated fluid emanating from said hair dryer and said member being congruently shaped to the configuration of the interior of the hood of said hooded hair dryer, and being adapted to have its lower perimetric edge be frictionally and releasably retained upon the lower portion of said hood.

15. A fluid diffusion member for use with heated fluids comprising: A non-planar, dome-shaped member of open-pore, lightweight material, being shaped and adapted to cooperate with a source of heated fluid, and having a thickness sufficient to satisfactorily diffuse the heated fluid emanating from said source and having spaced rib-like supporting members, said heated source being a hooded hair dryer and said fluid diffusion member being congruently shaped to the configuration of the interior thereof; said fluid diffusion member having a lower expansible, annular shaped member which is adjustable for friction retention cooperation with the interior surface of the hood of said dryer.

16. A fluid diffusion member for use with heated fluids comprising: A member of open-pore, lightweight, molded and heat-resistent material of polyurethane foam and being shaped and adapted for frictional retention within the hood of a hair dryer and having a thickness sufficient to satisfactorily diffuse the heated fluid emanating from said hair dryer, and said member being congruently shaped to the configuration of the interior of the hood of said hooded hair dryer, and being adapted to have its lower perimetric edge frictionally and releasably retained upon the lower edge portion of said hood.

* * * * *